US006184827B1

(12) United States Patent
Dendy et al.

(10) Patent No.: US 6,184,827 B1
(45) Date of Patent: Feb. 6, 2001

(54) LOW COST BEAM STEERING PLANAR ARRAY ANTENNA

(75) Inventors: Deborah Sue Dendy, Tempe; David Warren Corman, Gilbert; Stephen Chih-hung Ma; Archer David Munger, both of Mesa; Keith Vaclav Warble, Chandler, all of AZ (US)

(73) Assignee: Motorola, Inc., Schaumburg, IL (US)

( * ) Notice: Under 35 U.S.C. 154(b), the term of this patent shall be extended for 0 days.

(21) Appl. No.: 09/258,231

(22) Filed: Feb. 26, 1999

(51) Int. Cl.[7] ..... H01Q 3/26

(52) U.S. Cl. ..... 342/372; 342/368; 342/371; 342/377

(58) Field of Search ..... 342/367–377

(56) References Cited

U.S. PATENT DOCUMENTS

| | | | |
|---|---|---|---|
| 4,217,587 | 8/1980 | Jacomini . | |
| 4,849,763 | 7/1989 | DuFort | 342/372 |
| 5,349,364 | 9/1994 | Bryanos et al. . | |
| 5,557,286 | 9/1996 | Varadan et al. . | |
| 5,579,021 | 11/1996 | Lee . | |
| 5,940,029 * | 8/1999 | Ninomiya et al. | 342/372 |

FOREIGN PATENT DOCUMENTS

| | | |
|---|---|---|
| 2316234 | 2/1998 | (GB) . |
| 9935705 | 7/1999 | (WO) . |

* cited by examiner

*Primary Examiner*—Bernarr E. Gregory
(74) *Attorney, Agent, or Firm*—Frank J. Bogacz; Timothy J. Lorenz; Jeff D. Limon

(57) ABSTRACT

A planar array antenna for use with an earth-based subscriber unit generates receive or transmit communications beams through the use of digital beamforming networks (210, 211) which provide beam steering in a first dimension. In another dimension, the communications beams are synthesized by way of a waveguide structure (300, FIG. 3) which is repeated for each row of the antenna array. The waveguide outputs are weighted due to the positioning of coupling slots (350) or coupling probes (450) which transfer carrier signals to and from each waveguide. The slots or coupling probes from the waveguides are coupled to a group of barium strontium titanate (BST) (360, FIG. 3) or microelectromechanical systems (MEMS) switch (460, FIG. 4) phase shift elements which are under the control of a control network (221, 222, FIG. 2). The resulting signals are radiated by the antenna elements of the planar antenna array (310, FIG. 3) to form a communications beam.

10 Claims, 3 Drawing Sheets

LOW COST BEAM STEERING PLANAR ARRAY ANTENNA

FIELD OF THE INVENTION

The invention relates to antennas and, more particularly, to antennas which generate and steer communications beams.

BACKGROUND OF THE INVENTION

In a high bandwidth communications system where the communications nodes are in motion relative to earth-based subscriber units, a subscriber unit typically maintains a link with the moving communications node using a narrow communications beam. A narrow communications beam allows the earth-based subscriber unit to transmit information to and receive information from the moving communications node at high data rates. Typically, a more narrow receive or transmit beam allows a higher data rate to be used between the communications node and the earth-based subscriber.

Previous earth-based systems used for tracking moving communications nodes, such as low earth orbit satellites, involve the use of mechanically steered reflector antennas. However, when the communications node is a low earth orbit satellite, the satellite may travel from one horizon to another and be in view of the subscriber unit for only a few short minutes. Therefore, since the mechanically steered reflector antenna must constantly be moved in order to maintain the communications link between the satellite and the subscriber unit, the mechanical components begin to wear and must periodically be replaced. This periodic replacement increases the life cycle cost which an earth-based subscriber must pay in order to receive and transmit high-bandwidth information to and from a moving satellite communications node.

Some other techniques for maintaining a communications link with a moving communications node involve the use of two-dimensional electronically scanned antenna arrays through the use of a digital beamformer. In a two-dimensional array which uses a digital beamformer, each transmit antenna element incorporates an individual power amplifier. Additionally, each receive element incorporates an individual low noise amplifier. The need for individual amplification of both receive and transmit antenna elements, as well as the need to perform a large number of digital operations in the beamformer itself, as well as the need for interconnections between the beamformer and the array of antenna elements involves substantial complexity in the required electronics and is therefore cost prohibitive for use by individual earth-based subscribers.

Therefore, what is desirable, is a low-cost system with minimal moving parts to provide beam steering in the communications antenna of the subscriber unit. A low-cost beam steering communications antenna using fewer moving parts also increases the reliability of the antenna over complex mechanically steered systems. These features make communications with a moving satellite accessible to a greater number of users with increased reliability.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

DETAILED DESCRIPTION OF THE DRAWINGS

A low-cost system for beam steering in a communications antenna provides the capability for subscribers to receive and transmit high bandwidth information to and from moving satellite communications nodes. The system combines low-cost equipment which can be mass produced using semiconductor processes in order to provide a highly reliable and robust antenna which can establish and maintain a communications link with a moving communications node. Additionally, the use of two such hybrid antenna systems integrated into the same package enables a smooth handover of communications with one moving node to communications with a second moving node. Therefore, terrestrial-based users can maintain uninterrupted contact with the satellite communications network as each satellite comes within view. As each satellite nears the horizon, or becomes masked by foliage or other obstructions, a second communications beam can generated in order to establish a link with the second moving node which is within view of the antenna system. Furthermore, in the event that a moving communications node or other space-based emitter generates interference, the antenna system can minimize this interference by generating a null in the appropriate direction.

Figure 1:
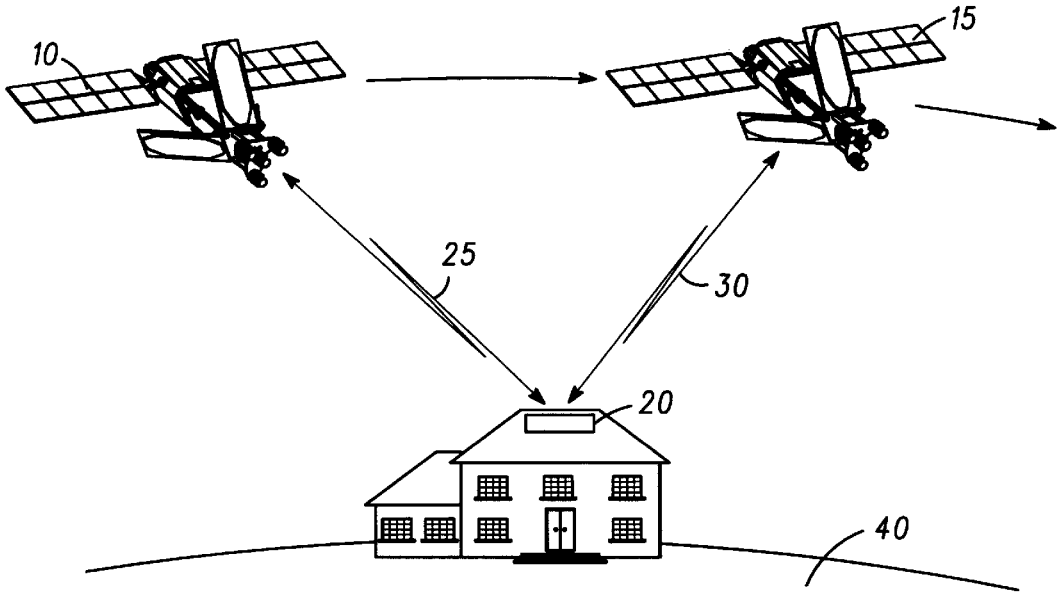
FIG. 1 is a block diagram and illustrates a ground based hybrid antenna system in communications contact with moving communications nodes in accordance with a preferred embodiment of the invention.

FIG. 1 is a block diagram and illustrates a ground based hybrid antenna system in communications contact with moving communications nodes in accordance with a preferred embodiment of the invention. In FIG. 1, satellite communications nodes 10 and 15 are in communications with earth-based subscriber unit 20 through communications beams 25 and 30, respectively. In a preferred embodiment, these communications nodes are representative of a global satellite network with an interface to a terrestrial voice and data infrastructure. Additionally, satellite communications nodes 10 and 15 can communicate with each other and other similar satellites through intersatellite cross-links. Thus, satellites 10 and 15 provide voice and data capabilities which enable earth-based subscriber unit 20 to transmit data to and receive data from the terrestrial voice and data infrastructure through satellite communications nodes 10 and 15.

In FIG. 1, satellite communications nodes 10 and 15 are in motion relative to earth-based subscriber unit 20. By way of example, and not by way of limitation, satellite communications node 15 is moving away from earth-based subscriber unit 20 and will soon pass beyond the horizon and out view of subscriber unit 20. Meanwhile, satellite communications node 10 is also in view of earth-based subscriber unit 20 and will soon be directly overhead of earth-based subscriber unit 20. In a preferred embodiment, earth-based subscriber unit 20 maintains a link with satellite communications nodes 10 and 15 as these satellites move relative to the surface of the earth 40. Each of satellite communications nodes 10 and 15 may originate from different points on the horizon as well as terminate at different points on the horizon. Thus, satellite communications node 10 may come into view of earth-based subscriber unit 20 from a direction of due North while satellite communications node 15 may come into view from a direction of North by Northeast. Further, satellite communications node 10 may terminate at a horizon location of due South while satellite communications node 15 may terminate at a horizon direction of South by Southwest.

In a preferred embodiment, earth-based subscriber unit 20 employs a "make before break" technique in which the communications link with satellite communications node 15 is maintained until a link with satellite communications node 10 can be established. Thus, only after a link with satellite communications node 10 has been established is the link with satellite communications node 15 discontinued. Consequently, earth-based subscriber unit 20 includes two independently steerable antennas in order to facilitate this capability.

Figure 2:
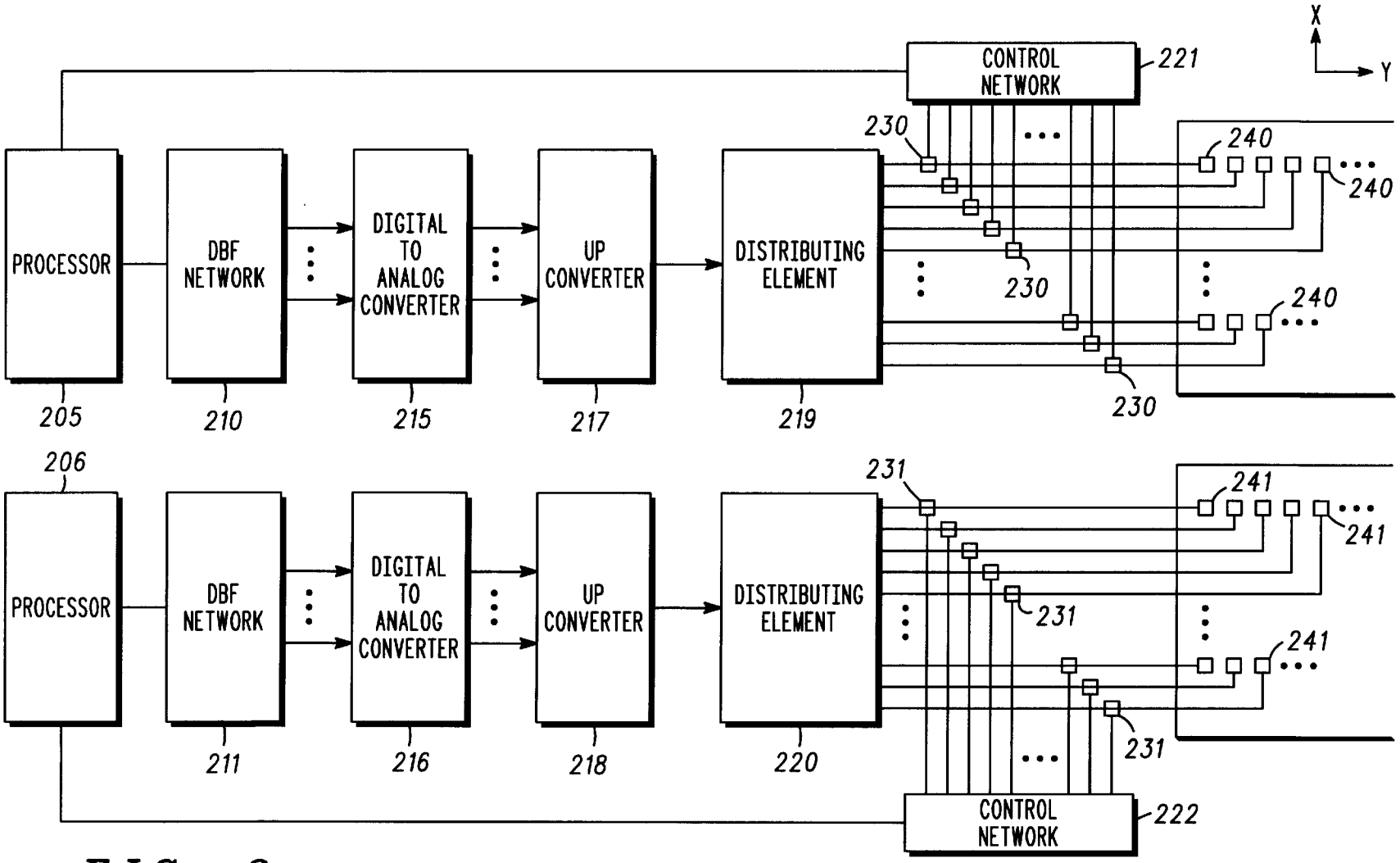
FIG. 2 is a block diagram and illustrates a hybrid antenna system which provides communications with moving communications nodes in accordance with a preferred embodiment of the invention.

FIG. 2 is a block diagram and illustrates a hybrid antenna system which provides communications with moving communications nodes in accordance with a preferred embodiment of the invention. In FIG. 2, processors 205 and 206 control the operations of digital beamforming networks 210 and 211. Additionally, processors 205 and 206 control the operations of control networks 221 and 222. In a preferred embodiment, processors 205 and 206 each maintain a record of the current locations of satellite communications nodes 10 and 15 of FIG. 1. Processors 205 and 206 command digital beamforming networks 210 and 211 as well as control networks 221 and 222 in order to adjust receive and transmit communications beams to the locations of satellite communications nodes 10 and 15. Processors 205 and 206 can also maintain a record of the locations of other satellites similar to satellite communications nodes 10 and 15 which are part of the global communications network. Further, processors 205 and 206 may also maintain a record of the locations of other satellite communications nodes which could interfere with transmissions from satellite communications nodes 10 and 15. This allows processors 205 and 206 to determine if a null or other minimum gain point of a communications beam should be directed toward the source of the interference in order to mitigate the effects of the interference on the communications.

In a preferred embodiment, digital beamforming networks 210 and 211 provide beam steering in a first dimension while control networks 221 and 222 provide beam steering in a second, and preferably orthogonal, dimension. Therefore, digital beamforming networks 210 and 211 may provide beam steering in a North South direction while control networks 221 and 222 provide beam steering in an East West direction. In the example of FIG. 2, each output of digital beamforming networks 210 and 211 provides beam steering commands which control a particular column of antenna elements 240 and 241. Thus, for this example, the complexity of each of digital beamforming networks 210 and 211 is driven only by the number of rows of antenna elements 240 and 241.

Digital beamforming networks 210 and 211 are coupled to digital to analog converters 215 and 216, respectively. Digital to analog converters 215 and 216 function to convert the digital inputs from digital beamforming networks 210 and 211 to analog waveforms. The analog waveforms from digital to analog converters 215 and 216 are conveyed to up converters 217 and 218, respectively. Up converters 217 and 218 function to convert the analog outputs of digital to analog converters 215 and 216 to carrier signals to that can be radiated by antenna elements 240 and 241.

The carrier signals from up converters 217 and 218 are input to distributing elements 219 and 220, respectively. In a preferred embodiment, distributing elements 219 and 220 convert an input from up converters 217 and 218 into a group of outputs. In a preferred embodiment, distributing elements 219 and 220 apply a weighting factor to each output. This allows each output to form the basis of an antenna radiation pattern in a dimension which is orthogonal to the dimension controlled by digital beamforming networks 210 and 211.

The outputs of distributing elements 219 and 220 are then coupled to phase shift elements 230 and 231, respectively. Phase shift elements 230 and 231 function to adjust the phase of the amplitude tapered outputs from distributing elements 219 and 220 so that an antenna radiation pattern can be generated in a dimension which is preferably orthogonal to the dimension controlled by digital beamforming networks 210 and 211. In a preferred embodiment, control networks 221 and 222 control the amount of phase shifting applied to each of phase shift elements 230 and 231. Through this control and occasional modification of phase, the resulting antenna radiation pattern can be steered to the desired location in the orthogonal dimension.

The outputs of phase shift elements 230 and 231 are coupled to antenna elements 240. In a preferred embodiment, antenna elements 240 and 241 are arranged in a two dimensional array. Antenna elements 240 and 241 can be any type of radiating elements such as a dipole, monopole above a ground plane, patch, or any other type of conductive element in which an electromagnetic wave is launched in response to an electrical current being generated on a conductive surface. Additionally, antenna elements 240 and 241 can comprise a waveguide slot or other type of radiating element which produces an electromagnetic wave as a function of an electric field being generated within the waveguide slot. Finally, antenna elements 240 and 241 can comprise a microstrip element which produces an electromagnetic wave as a function of a change in impedance caused by a notch or other indentation made in the microstrip transmission line.

Although FIG. 2 describes the elements which are desirable for synthesizing a transmit communications beam, a receive communications beam can be generated using reciprocal system hardware. For the case of generating a receive communications beam, a group of low noise amplifiers are preferably inserted in series with each of antenna elements 240 and 241. The amplified signals from antenna elements 240 and 241 are phase shifted by way of control networks 221 and 222 and combined by way of distributing element 219 and 220 which are preferably linear, two way devices. In an alternate embodiment, low noise amplifiers are placed at the output of distributing elements 219 and 220 so that only the combined signal is amplified. This is advantageous since the number of low noise amplifiers is reduced from an amount equal to the number of antenna elements 240 and 241 to an amount equal the number of columns of the antenna elements.

The resultant combined receive signals are down converted by way of down converters which are inserted in place of up converters 217 and 218. The down converted signals are input to analog to digital converters which are preferably inserted in place of digital to analog converters 215 and 216. The resultant digital inputs are then conveyed to a receive digital beam forming networks which are similar to digital beam forming networks 210 and 211.

Figure 3:
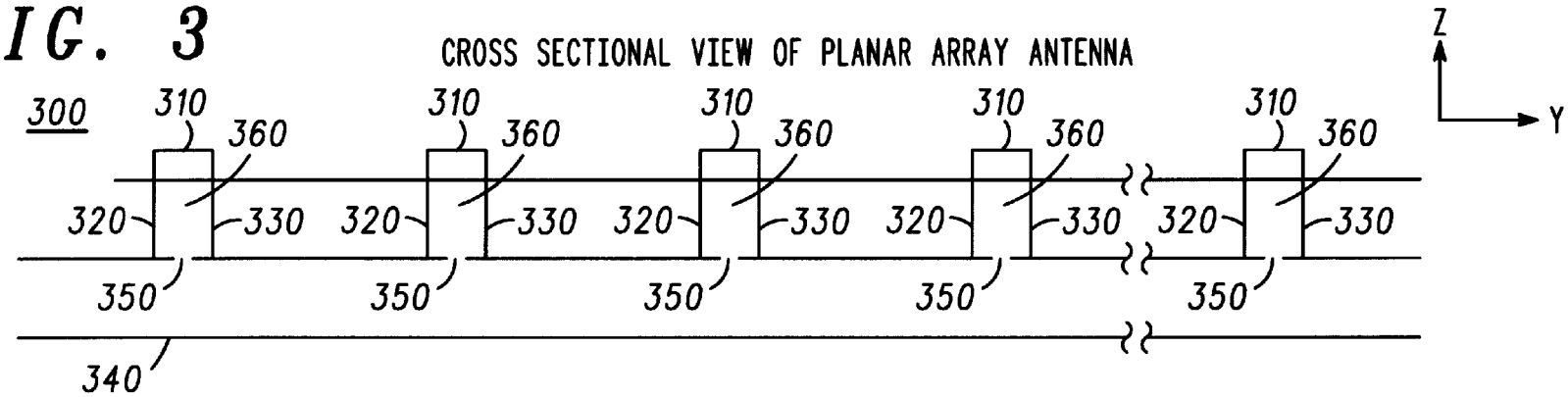
FIG. 3 illustrates a cross-sectional view of a hybrid antenna system employing Barium Strontium Titanate voltage controlled dielectric phase shift elements in accordance with a preferred embodiment of the invention.

FIG. 3 illustrates a cross-sectional view of a portion of a hybrid antenna system (300) employing barium strontium titanate voltage controlled dielectric phase shift elements in accordance with a preferred embodiment of the invention. The structure of FIG. 3 (300) is repeated for each row of antenna elements 310 which comprise the antenna system. Antenna elements 310 are similar to antenna elements 240 or 241 of FIG. 2.

In FIG. 3, waveguide 340 is used as a distributing element which performs the function of distributing element 219 of FIG. 2. Carrier signal inputs are coupled from waveguide 340 into barium strontium titanate media 360. Although a barium strontium titanate phase shift element is used in the example of FIG. 3, other ferroelectric media which exhibit variable dielectric properties as a function of a control voltage applied across a section of the dielectric media can be used. In a preferred embodiment, coupling slots 350 are cut into a wall of waveguide 340 and barium strontium titanate media is in intimate contact with waveguide 340. The size of each of coupling slots 350 and the position of each slot on the wall of waveguide 340 determine the amount of carrier signal energy coupled from waveguide 340 into barium strontium titanate media 360. Although this embodiment makes use of a waveguide and coupling slots, these are provided by way of example, and not by limitation. Other transmission lines structures, such as microstrip or stripline, as well as with other coupling techniques, such as microstrip coupled lines, can also be used to perform the function of distributed element 219 or 220 of FIG. 2.

The carrier signal energy from each of coupling slots 350 is then propagated through barium strontium titanate media 360. As known to those skilled in the art, barium strontium titanate possesses a physical property of a changing dielectric constant in response to a voltage applied across anode 320 and cathode 330. Although not shown in FIG. 3, anode 320 and cathode 330 are connected to a control network such as one of control networks 221 and 222 of FIG. 2. A control signal in the form of an analog voltage from the control networks applied across anode 320 and cathode 330 functions to change the phase of the carrier signal traveling through barium strontium titanate media 360.

The phase shifted carrier signal output is coupled to one of antenna elements 310. The lower conductive side of each of antenna elements 310 is in intimate contact with barium strontium titanate media 360. Thus, the incoming carrier signal from the barium strontium titanate media excites a current on the upper surface of each of antenna elements 310. This, in turn, causes an electromagnetic signal to be radiated from the upper surface of each of antenna elements 310. The radiated energy from each of antenna elements interferes constructively and destructively at specific angles in front of the antenna system of FIG. 3, thus producing the desired antenna radiation pattern in the dimension along the "Z" axis of FIG. 3 which is steerable in the "Y" axis.

Although described as a transmit antenna, the reciprocal nature of the antenna of FIG. 3 allows the antenna to generate a receive communication beam as well as a transmit communications beam.

Figure 4:
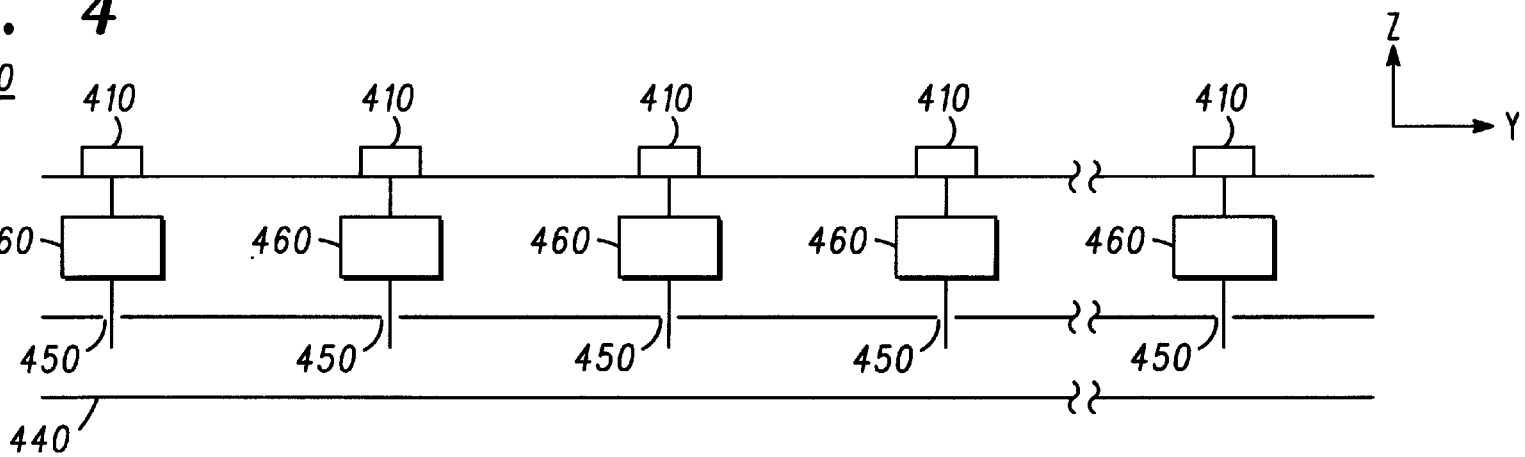
FIG. 4 illustrates a cross-sectional view of another hybrid antenna system employing micro-electromechanical systems (MEMS) switches as phase shift elements in accordance with a preferred embodiment of the invention.

FIG. 4 illustrates a cross-sectional view of a section of another hybrid antenna system (400) employing microelectromechanical systems (MEMS) switches as phase shift elements in accordance with a preferred embodiment of the invention. The structure of FIG. 4 (400) is repeated for each row of antenna elements 310 which comprise the antenna system. Antenna elements 410 are similar to antenna elements 240 or 241 of FIG. 2.

In FIG. 4, coupling probes 450 extend into waveguide 440. The placement of coupling probes 450 on the wall of waveguide 440 controls the amount of energy coupled from waveguide 440 into the coupling probe. Each coupling probe conveys carrier signal energy to one of MEMS switch groups 460. Although not shown in FIG. 4, each MEMS switch group is controlled by a discrete voltage from a control network such as one of control networks 221 and 222 of FIG. 2.

In a preferred embodiment, a connection to a control network allows MEMS switch groups 460 to switch in and switch out sections of transmission line in the carrier signal path from waveguide 440 to antenna elements 410. Through this change in the length of the carrier signal path, the relative phase of each signal coupled to antenna elements 410 can be controlled. In a preferred embodiment, each MEMS switch group includes a loaded line microstrip phase shifter including eight switches in order to provide four-bit phase resolution of 22.5 degrees. However, a greater or lesser number of MEMS switches may be employed according to the phase resolution requirements of the particular application.

The phase shifted carrier signal output from each MEMS switch is coupled to a matching layer in order to couple a maximum amount of carrier signal energy to each one of antenna elements 410. As the carrier signal is coupled to each of antenna elements 410, an electromagnetic signal is radiated from the upper surface of each of antenna elements 410. The radiated energy from each of antenna elements interferes constructively and destructively at specific angles in front of the antenna system of FIG. 4, thus producing the desired antenna radiation pattern in the dimension along the "Z" axis and steerable in the "Y" dimension of FIG. 4.

Although described as a transmit antenna, the reciprocal nature of the antenna of FIG. 4 allows the antenna to generate a receive communication beam as well as a transmit communications beam.

Figure 5:
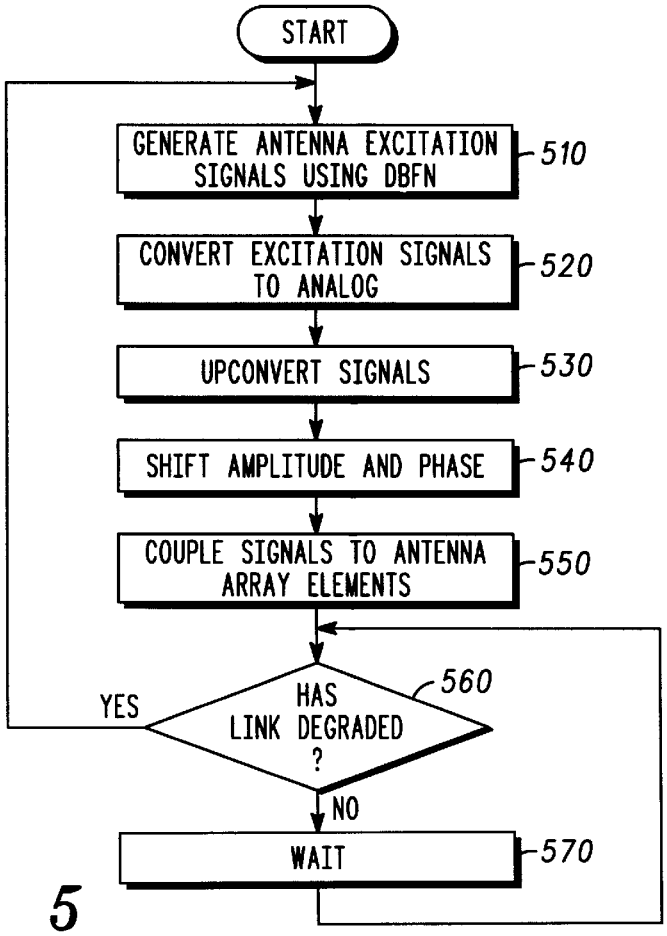
FIG. 5 is a flow chart and illustrates a method of steering a communications beam using a digital beamformer and plurality of phase shift elements in accordance with a preferred embodiment of the invention.

FIG. 5 is a flow chart and illustrates a method of steering a communications beam using a digital beamformer and plurality of phase shift elements in accordance with a preferred embodiment of the invention. The antenna system of FIG. 2 is suitable for performing the invention. The method begins at step 510 with a plurality of antenna excitation signals being generated using a digital beamforming network. Step 510 includes a summation of a plurality of antenna element signals from each digitally generated beam multiplied by a plurality of amplitude weighting functions to form a plurality of digital representations of amplitude and phase of the antenna excitation signals.

In step 520, antenna excitation signals from the output of the digital beamforming network are converted to analog waveforms to create analog representations of antenna excitation signals which are up converted in step 530. In step 540, the amplitude and phase of certain ones of the antenna excitation signal are shifted in order to produce amplitude and phase shifted antenna excitation signals.

In step 550, the amplitude and phase shifted antenna excitation signals are coupled to an antenna array allowing information to be transmitted to or received from a satellite communications node. In step 560, the quality of the communications link is evaluated in order to determine if any steering adjustments to the beam need to be performed. In the event that the link between the satellite communications node and the antenna system is acceptable, the method waits for a predetermined period of time, as in step 570. After this time has expired, the method returns to step 560 where the link quality is again evaluated.

In the event that the link quality evaluation of step 560 determines that the link with the satellite communications node is degraded, the method returns to step 510 where the communications beam is adjusted. By repeating steps 510 through 560, a robust link with a moving satellite communications node can be maintained.

A method similar to that of FIG. 5 can be envisioned for the antenna of FIG. 2 generating a receive communications beam. In this embodiment, the method begins with coupling signals transmitted from an external source to the antenna array elements. In the next step, the amplitude and phase of each of the received signals are modified and combined. The method continues with a down conversion of the receive signals, followed by a conversion from an analog representation to a digital representation of each signal. In the final step of the method, the digital representation of each signal is fed to a digital beamforming network.

A low-cost system for beam steering in a communications antenna provides the capability for subscribers to receive and transmit high bandwidth information to and from a moving communications node. The system combines low-cost equipment operated with minimal or no moving parts in order to provide a highly reliable antenna which can communicate with a moving communications node. Additionally, the use of two hybrid antenna systems enables a smooth hand-over from communications with one moving node to communications with a second moving node. Therefore, users can maintain contact with the satellite communications system without interruption. Furthermore, in the event that a moving communications node generates interference, the antenna can minimize interference from the interfering satellites by generating a null in the appropriate direction. For these reasons and others, the system represents a significant advancement in satellite communications technology by providing the general public with the capability to receive satellite communications services at a minimal cost.

Accordingly, it is intended by the appended claims to cover all modifications of the invention that fall within the true spirit and scope of the invention.

What is claimed is:

1. An antenna for generating a communications beam which is steerable in a first and second dimension, said antenna comprising:

a digital beamforming network configured to create a beam that is steerable in said first dimension;

a plurality of barium strontium titanate phase shift elements coupled to said digital beamforming network and each of said plurality of barium strontium titanate phase shift elements coupled to one of a plurality of radiating elements; and a control network coupled to each of the plurality of barium strontium titanate phase shift elements, the control network configured to control an amount of phase shift of each of the plurality of barium strontium titanate phase shift elements in order to steer the communications beam in a second dimension.

2. The antenna of claim 1, wherein the control network supplies an analog voltage to the plurality of barium strontium titanate phase shift elements in order to steer the communications beam in the second dimension.

3. The antenna of claim 1, wherein each of the plurality of barium strontium titanate phase shift elements comprises a microstrip phase shifter, which includes at least one micro-electromechanical systems (MEMS) switch.

4. The antenna of claim 3, wherein the control network supplies a discrete voltage to the at least one MEMS switch in order to steer the communications beam in the second dimension.

5. The antenna of claim 1, wherein the antenna is included in a subscriber unit which communicates with an orbiting satellite communications node.

6. The antenna of claim 5, wherein the antenna further comprises an interface to a processor which controls steering of the communications beam in order to maintain a communications link with an orbiting satellite communications node.

7. The antenna of claim 1, wherein said digital beamforming network is adapted to receive communications beams.

8. An system for generating a communications beam which is steerable in one dimension, comprising:

a distributing element for distributing carrier signals, said distributing element comprising a waveguide having coupling slots, which are cut into a wall of said waveguide;

a plurality of barium strontium titanate phase shift elements coupled to said distributing element;

a control network coupled to said plurality of barium strontium titanate phase shift elements, said control network supplying a voltage which controls an amount of phase shift applied to said carrier signals; and a plurality of antenna elements for radiating said carrier signals.

9. The system of claim 8, wherein said plurality of barium strontium titanate phase shift elements comprise a MEMS switch.

10. The system of claim 8, wherein said distributing element comprises a waveguide having coupling probes inserted into a wall of said waveguide.

* * * * *